United States Patent [19]

Grappendorf

[11] Patent Number: 4,586,574

[45] Date of Patent: May 6, 1986

[54] CUTTER CONFIGURATION FOR A GAGE-TO-SHOULDER TRANSITION AND FACE PATTERN

[75] Inventor: Richard H. Grappendorf, Riverton, Utah

[73] Assignee: Norton Christensen, Inc., Salt Lake City, Utah

[21] Appl. No.: 496,611

[22] Filed: May 20, 1983

[51] Int. Cl.[4] ..... E21B 10/46

[52] U.S. Cl. ..... 175/329; 175/410

[58] Field of Search ..... 175/329, 330, 410, 409, 175/385, 389, 390, 391, 392; 407/57, 58, 59, 61

[56] References Cited

U.S. PATENT DOCUMENTS 3,727,704 4/1973 Ablanalp ..... 175/329

OTHER PUBLICATIONS

General Electric, "Geoset Drill Diamond", SMD18-404(10M), Oct. 1982.

*Primary Examiner*—Stephen J. Novosad
*Assistant Examiner*—Thuy M. Bui
*Attorney, Agent, or Firm*—Beehler, Pavitt, Siegemund, Jagger & Martella

[57] ABSTRACT

Shortening of the bit life and premature failure of cutting elements on a rotating bit near or at the gage of the bit can be avoided by disposition of the cutting elements at or below a key level on the shoulder-to-gage transition. A first tooth is placed on the shoulder of a rotating bit at the key level. The key level is defined as that point on the shoulder of the rotating bit at which a tooth extends radially from the axis of the rotating bit by a distance substantially equal to the diameter of the bore drilled by the rotating bit as also defined by the gage diameter of the rotating bit. Below the key level the teeth are set on the pads in a staggered pattern that serve to increase effective cutting element concentration. The staggered pattern is repeated within a pad and between pads in selected areas. Distinguishable cutting elements are alternated within the pattern.

22 Claims, 10 Drawing Figures

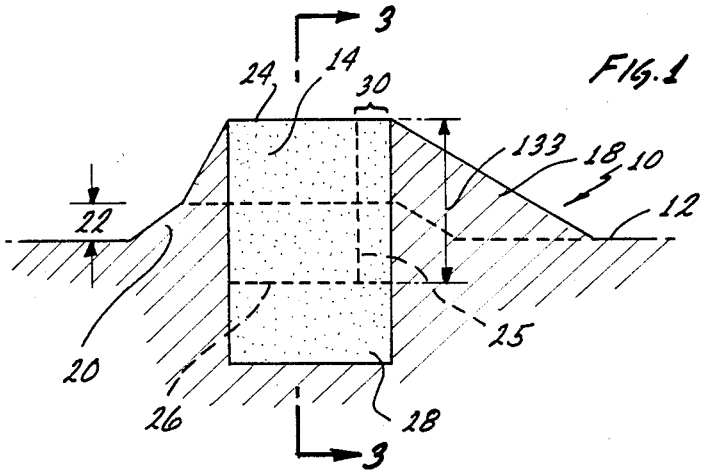
FIG. 1
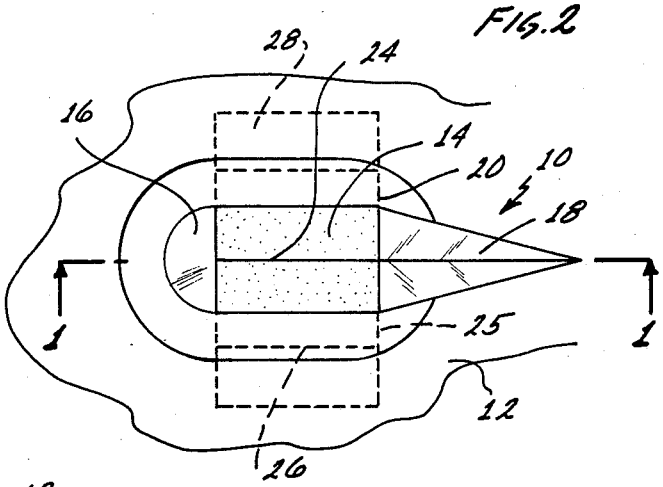
FIG. 2
FIG. 3
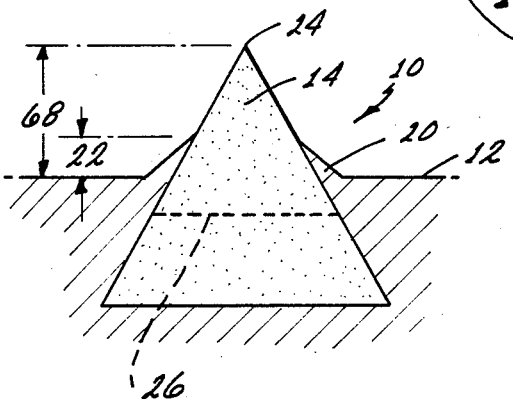
FIG. 7
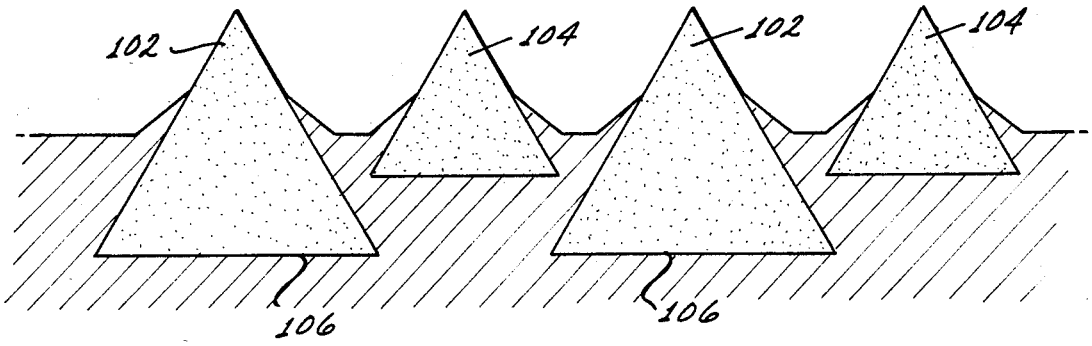

CUTTER CONFIGURATION FOR A GAGE-TO-SHOULDER TRANSITION AND FACE PATTERN

FIELD OF THE INVENTION

The present invention relates to the field of earth boring bits and more particularly to rotary bits employing diamond cutting elements.

DESCRIPTION OF THE PRIOR ART

The use of diamonds in drilling products is well known. More recently synthetic diamonds both single crystal diamonds (SCD) and polycrystalline diamonds (PCD) have become commercially available from various sources and have been used in such products, with recognized advantages. For example, natural diamond bits effect drilling with a plowing action in comparison to crushing in the case of a roller cone bit, whereas synthetic diamonds tend to cut by a shearing action. In the case of rock formations, for example, it is believed that less energy is required to fail the rock in shear than in compression.

More recently, a variety of synthetic diamond products has become available commercially some of which are available as polycrystalline products. Crystalline diamonds preferentially fractures on (111), (110) and (100) planes whereas PCD tends to be isotropic and exhibits this same cleavage but on a microscale and therefore resists catastrophic large scale cleavage failure. The result is a retained sharpness which appears to resist polishing and aids in cutting. Such products are described, for example, in U.S. Pat. Nos. 3,913,280; 3,745,623; 3,816,085; 4,104,344 and 4,224,380.

In general, the PCD products are fabricated from synthetic and/or appropriately sized natural diamond crystals under heat and pressure and in the presence of a solvent/catalyst to form the polycrystalline structure. In one form of product, the polycrystalline structures includes sintering aid material distributed essentially in the interstices where adjacent crystals have not bonded together.

In another form, as described for example in U.S. Pat. Nos. 3,745,623; 3,816,085; 3,913,280; 4,104,223 and 4,224,380 the resulting diamond sintered product is porous, porosity being achieved by dissolving out the nondiamond material or at least a portion thereof, as disclosed for example, in U.S. Pat. Nos. 3,745,623; 4,104,344 and 4,224,380. For convenience, such a material may be described as a porous PCD, as referenced in U.S. Pat. No. 4,224,380.

Polycrystalline diamonds have been used in drilling products either as individual compact elements or as relatively thin PCD tables supported on a cemented tungsten carbide (WC) support backings. In one form, the PCD compact is supported on a cylindrical slug about 13.3 mm in diameter and about 3 mm long, with a PCD table of about 0.5 to 0.6 mm in cross section on the face of the cutter. In another version, a stud cutter, the PCD table also is supported by a cylindrical substrate of tungsten carbide of about 3 mm by 13.3 mm in diameter by 26 mm in overall length. These cylindrical PCD table faced cutters have been used in drilling products intended to be used in soft to medium-hard formations.

Individual PCD elements of various geometrical shapes have been used as substitutes for natural diamonds in certain applications on drilling products.

However, certain problems arose with PCD elements used as individual pieces of a given carat size or weight. In general, natural diamond, available in a wide variety of shapes and grades, was placed in predefined locations in a mold, and production of the tool was completed by various conventional techniques. The result is the formation of a metal carbide matrix which holds the diamond in place, this matrix sometimes being referred to as a crown, the latter attached to a steel blank by a metallurgical and mechanical bond formed during the process of forming the metal matrix. Natural diamond is sufficiently thermally stable to withstand the heating process in metal matrix formation.

In this procedure above described, the natural diamond could be either surface-set in a predetermined orientation, or impregnated, i.e., diamond is distributed throughout the matrix in grit or fine particle form.

With early PCD elements, problems arose in the production of drilling products because PCD elements especially PCD tables on carbide backing tended to be thermally unstable at the temperature used in the furnacing of the metal matrix bit crown, resulting in catastrophic failure of the PCD elements if the same procedures as were used with natural diamonds were used with them. It was believed that the catastrophic failure was due to thermal stress cracks from the expansion of residual metal or metal alloy used as the sintering aid in the formation of the PCD element.

Brazing techniques were used to fix the cylindrical PCD table faced cutter into the matrix using temperature unstable PCD products. Brazing materials and procedures were used to assure that temperatures were not reached which would cause catastrophic failure of the PCD element during the manufacture of the drilling tool. The result was that sometimes the PCD components separated from the metal matrix, thus adversely affecting performance of the drilling tool.

With the advent of thermally stable PCD elements, typically porous PCD material, it was believed that such elements could be surface-set into the metal matrix much in the same fashion as natural diamonds, thus simplifying the manufacturing process of the drill tool, and providing better performance due to the fact that PCD elements were believed to have advantages of less tendency to polish, and lack of inherently weak cleavage planes as compared to natural diamond.

Significantly, the current literature relating to porous PCD compacts suggests that the element be surface-set. The porous PCD compacts, and those said to be temperature stable up to about 1200° C. are available in a variety of shapes, e.g., cylindrical and triangular. The triangular material typically is about 0.3 carats in weight, measures 4 mm on a side and is about 2.6 mm thick. It is suggested by the prior art that the triangular porous PCD compact be surface-set on the face with a minimal point exposure, i.e., less than 0.5 mm above the adjacent metal matrix face for rock drills. Larger one per carat synthetic triangular diamonds have also become available, measuring 6 mm on a side and 3.7 mm thick, but no recommendation has been made as to the degree of exposure for such a diamond. In the case of abrasive rock, it is suggested by the prior art that the triangular element be set completely below the metal matrix. For soft nonabrasive rock, it is suggested by the prior art that the triangular element be set in a radial orientation with the base at about the level of the metal matrix. The degree of exposure recommended thus depended on the type of rock formation to be cut.

The difficulties with such placements are several. The difficulties may be understood by considering the dynamics of the drilling operation. In the usual drilling operation, be it mining, coring, or oil well drilling, a fluid such as water, air or drilling mud is pumped through the center of the tool, radially outwardly across the tool face, radially around the outer surface (gage) and then back up the bore. The drilling fluid clears the tool face of cuttings and to some extent cools the cutter face. Where there is insufficient clearance between the formation cut and the bit body, the cuttings may not be cleared from the face, especially where the formation is soft or brittle. Thus, if the clearance between the cutting surface-formation interface and the tool body face is relatively small and if no provision is made for chip clearance, there may be bit clearing problems.

Other factors to be considered are the weight on the drill bit, normally the weight of the drill string and principally the weight of the drill collar, and the effect of the fluid which tends to lift the bit off the bottom. It has been reported, for example, that the pressure beneath a diamond bit may be as much as 1000 psi greater than the pressure above the bit, resulting in a hydraulic lift, and in some cases the hydraulic lift force exceeds 50% of the applied load while drilling.

One surprising observation made in drill bits having surface-set thermally stable PCD elements is that even after sufficient exposure of the cutting face has been achieved, by running the bit in the hole and after a fraction of the surface of the metal matrix was abraded away, the rate of penetration often decreases. Examination of the bit indicates unexpected polishing of the PCD elements. Usually ROP can be increased by adding weight to the drill string or replacing the bit. Adding weight to the drill string is generally objectionable because it increases stress and wear on the drill rig. Further, tripping or replacing the bit is expensive since the economics of drilling in normal cases are expressed in cost per foot of penetration. The cost calculation takes into account the bit cost plus the rig cost including trip time and drilling time divided by the footage drilled.

Clearly, it is desirable to provide a drilling tool having thermally stable PCD elements and which can be manufactured at reasonable costs and which will perform well in terms of length of bit life and rate of penetration.

It is also desirable to provide a drilling tool having thermally stable PCD elements so located and positioned in the face of the tool as to provide cutting without a long run-in period, and one which provides a sufficient clearance between the cutting elements and the formation for effective flow of drilling fluid and for clearance of cuttings.

Run-in in synthetic PCD bits is required to break off the tip or point of the triangular cutter before efficient cutting can begin. The amount of tip loss is approximately equal to the total exposure of natural diamonds. Therefore, an extremely large initial exposure is required for synthetic diamonds as compared to natural diamonds. Therefore, to accommodate expected wearing during drilling, to allow for tip removal during run-in, and to provide flow clearance necessary, substantial initial clearance is needed.

Still another advantage is the provision of a drilling tool in which thermally stable PCD elements of a defined predetermined geometry are so positioned and supported in a metal matrix as to be effectively locked into the matrix in order to provide reasonably long life of the tooling by preventing loss of PCD elements other than by normal wear.

It is also desirable to provide a drilling tool having thermally stable PCD elements so affixed in the tool that it is usable in specific formations without the necessity of significantly increased drill string weight, bit torque, or significant increases in drilling fluid flow or pressure, and which will drill at a higher ROP than conventional bits under the same drilling conditions.

BRIEF SUMMARY OF THE INVENTION

The improvement of the present invention includes a plurality of PCD cutting elements disposed on the apex, nose flank and shoulder of a rotating drill bit. The elements disposed on the apex, nose, flank and shoulder extend therefrom by a first predetermined distance. The rotating drill bit also includes a gage which defines the circumferential perimeter with a plurality of diamond elements disposed on the gage. The diamone elements disposed on the gage extend from the rotating bit by a second predetermined distance. The diameter of the hole bored by the rotating bit is defined by the diamond elements disposed on the gage and by the PCD elements disposed at or near a key level on the shoulder. The PCD cutting elements are disposed on the shoulder only up to the key level. The key level is defined as that level with respect to the gage of the rotating bit where the PCD element disposed at the key level defines a drilled bore substantially equal in diameter to the diameter defined by the diamond elements disposed on the gage.

These and other aspects in various embodiments of the present invention can better be understood by reviewing the following Figures in light of the following detailed description.

BRIEF DESCRIPTION OF THE DRAWINGS

FIG. 1 is a longitudinal sectional view of a tooth improved according to the present invention.

FIG. 2 is a plan view of the tooth shown in FIG. 1.

FIG. 3 is a cross sectional view taken through line 3—3 of FIG. 1.

FIG. 7 is a diagrammatic cross sectional view taken along line 7—7 of FIG. 5*b* showing two sizes of PCD elements adjacently disposed in a row of teeth.

Figure 4:
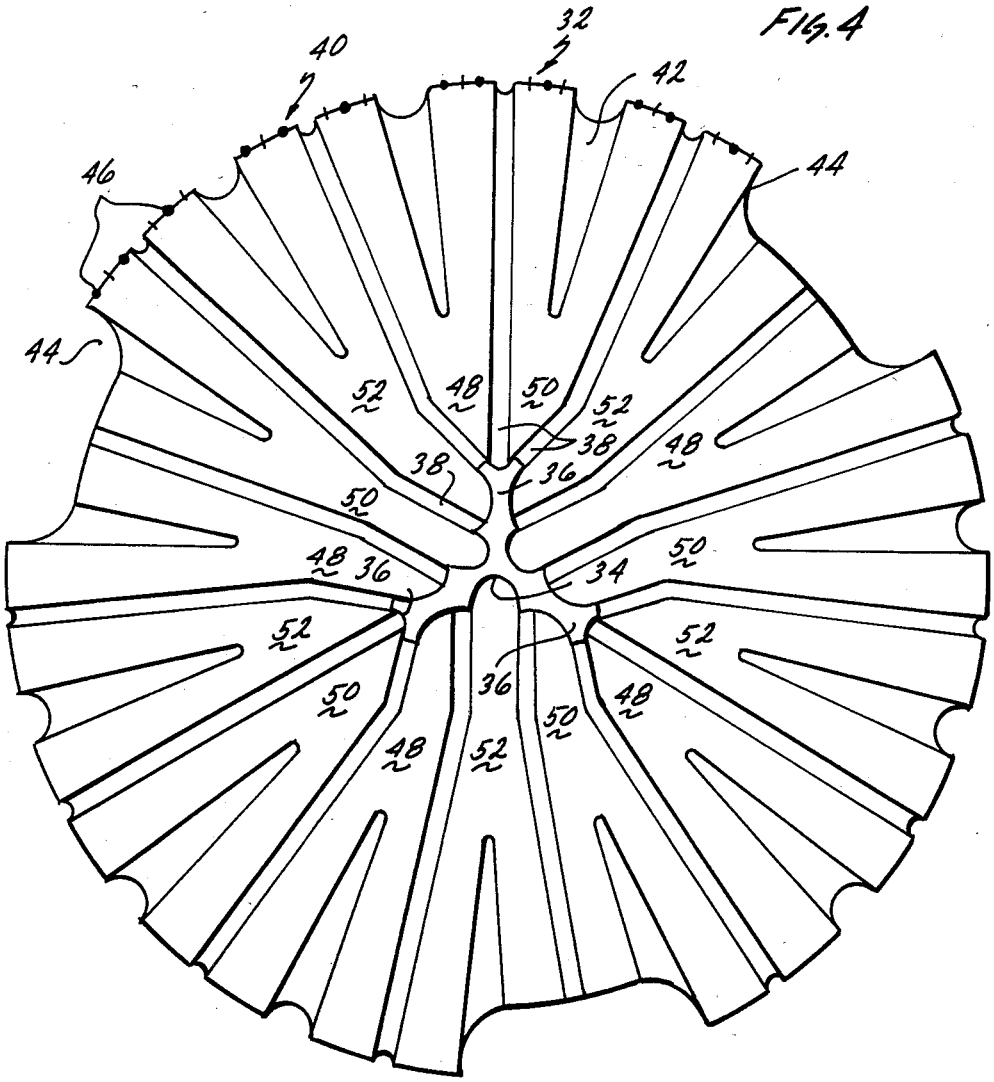
FIG. 4 is a diagrammatic plan view of a rotating bit showing a pad layout whereon a tooth configuration improved according to the present invention is disposed.

The present invention and its various embodiments may be better understood by viewing the above Figures in light of the following description.

DETAILED DESCRIPTION OF THE PREFERRED EMBODIMENTS

The present invention is an improvement in diamond tooth design and tooth configuration in a rotary bit. The useful life of a diamond rotating bit can be extended by using a tooth design and tooth configuration which retains the diamond cutting element on the face of the rotating cutting bit for a longer period and which maximizes the useful life of the diamond cutting element by avoiding loss and premature damage or fracture to the diamond cutting element.

To extend the useful life of the diamond cutting element, the triangular, prismatic shaped synthetic polycrystalline diamonds are exposed to the maximum extent from the bit face of the drill. However, the farther such diamonds are exposed from the bit face, the less they are embedded and secured within the bit face. Although the degree of security and retention of such a diamond cutting element can be increased by providing an integral extension of the diamond face in the form of a trailing support, the present invention has further improved the security of retention by forming a generally oval shaped collar about the base of a generally teardrop-shaped cutting tooth having a leading face formed by the diamond cutting element and about at least a portion of the trailing support forming the tail of an otherwise teardrop-shaped tooth. Thus, the tooth in plan view as described below takes the form and appearance of a teardrop-shaped tooth having a generally ovulate collar extending about the midsection of the tooth. This allows the diamond to be exposed to the maximum extent while providing additional integral matrix material to secure the diamond to the bit face while using a minimum of such matrix material projecting from the bit face. The diamond may in fact be disposed entirely above the bit face if desired.

In addition, premature fracture of these maximally exposed diamond cutting elements can be avoided, particularly at the shoulder-to-gage transition, where the maximum cutting action occurs in a diamond rotary bit, by placing the most radially disposed polycrystalline diamond cutting tooth, such as described above, at a key level on the shoulder at which key level the diamond extends in a radial distance from the centerline of the rotary bit by a distance substantially equal to the distance of the diamond cutting elements on the gage of the bit. By this placement, polycrystalline diamond cutting elements in the shoulder form a smooth cutting transition to the natural diamond cutting elements on the gage.

The present invention can be better understood by considering the above general description in the context of the Figures.

Referring now to FIG. 1, a longitudinal section of a tooth generally denoted by reference number 10 is illustrated as taken through line 1—1 of FIG. 2. Tooth 10 is particularly characterised by a polycrystalline diamond cutting element 14 in combination with matrix material integrally extending from rotary bit face 12 to form a prepad 16 and trailing support 18. As previously stated, prepad 16 can be deleted without departing from the teachings of the invention. The nature of prepad 16 and trailing support 18 are better described in copending U.S. Pat. No. 4,491,188 assigned to the same Assignee. However, tooth 10 of FIG. 1 differs from that described in the above denoted application by reason of an integrally formed, ovulate shaped collar 20 extending from bit face 12 by a height 22.

As better seen in plan outline in FIG. 2, tooth 10 has a main body portion principally characterised by a generally triangularly prismatic shaped polycrystalline diamond element 14. The apical edge 24 of diamond element 14 is illustrated in solid outline while its sides 25 and base 26 are shown in dotted and solid outline in FIGS. 1–3. Generally oval-shaped collar 20 completely circumscribes the main body of tooth 10 and in particular, diamond element 14. As better shown in longitudinal sectional view in FIG. 1 and in perpendicular sectional view in FIG. 3 taken through line 3—3 of FIG. 1, collar 20 extends from bit face 12 by a preselected height 22 to provide additional matrix material. The matrix material is integrally formed with bit face 12 by conventional metallic casting and powder metallurgy techniques to more firmly embed diamond element 14 within bit face 12. However, an amount of diamond element 14 has been extended from bit face 12 leaving predetermined portions of elements 14 uncovered by any matrix material as best illustrated in FIG. 3. However, with the addition of a minimal amount of integrally formed matrix material, collar 20 provides additional lateral, forward and rearward support to element 14 to secure element 14 to bit face 12.

Thus, tooth 10 as shown in FIG. 2 forms a singular geometric shape generally described as a teardrop-shaped tooth having a generally oval-shaped collar disposed around the triangular prismatic-shaped diamond element. This shape is illustrative only and any tooth design could be used with equal facility in the present invention.

FIG. 1 also shows in solid outline a second, larger similar triangular prismatic shaped diamond element 28 which has the same substantial shape as element 14 but can be included within tooth 10 as an alternative substitute cutting element of larger dimension. Specifically, element 14 is a conventionally manufactured polycrystalline diamond stone manufactured by General Electric Company under the trademark GEOSET 2102, while larger cutting element 28 is a similarly shaped but larger polycrystalline diamond stone manufactured by General Electric Company under the trademark GEOSET 2103. Thus, the same tooth 10 may accommodate alternately either diamond cutting element while having a similar exposure profile above bit face 12. In the case of smaller diamond element 14, trailing support 18 is integrally continued through portion 30 to provide additional trailing support to the smaller diamond element 14, which portion 30 is deleted and replaced by larger diamond element 28 in the alternative embodiment when the larger diamond is used.

The teeth improved according to the present invention are also used in an improved configuration on a rotary drilling bit as shown by way of example in the bit face diagrammatically illustrated in plan view in FIG. 4. Rotary bit 32 is shown illustratively as a petroleum bit divided into three symmetric sectors about center 34 of bit 32 wherein each sector is set off from the other by a main waterway 36. As is well known to the art, main waterways 36 are subdivided into a plurality of water courses 38 which extend from the center region of bit 32 to its periphery defined by the cylindrical sides of gage 40 of bit 32. In addition, a plurality of conventional collectors 42 are provided alternatively between waterways 38 in addition to symmetrically disposed junk slots 44. Waterways 38, collectors 42, and junk slots 44 are formed according to conventional design principles well known to the art and will not be further described here. However, it should be understood that any style rotary bit could be used in combination with the present invention without departing from the spirit and scope of the invention notwithstanding differences in the style or design of the hydraulic configuration of face of bit 32.

Gage 40 of bit 32 is defined by a plurality of cutting elements 46 which include diamond cutting elements affixed to or disposed in gage 40. Such elements include synthetic diamond cutting elements as well as conventional natural diamonds set within longitudinal matrix ridges integrally formed as part of gage 40 in a conventional manner.

Figure 5A:
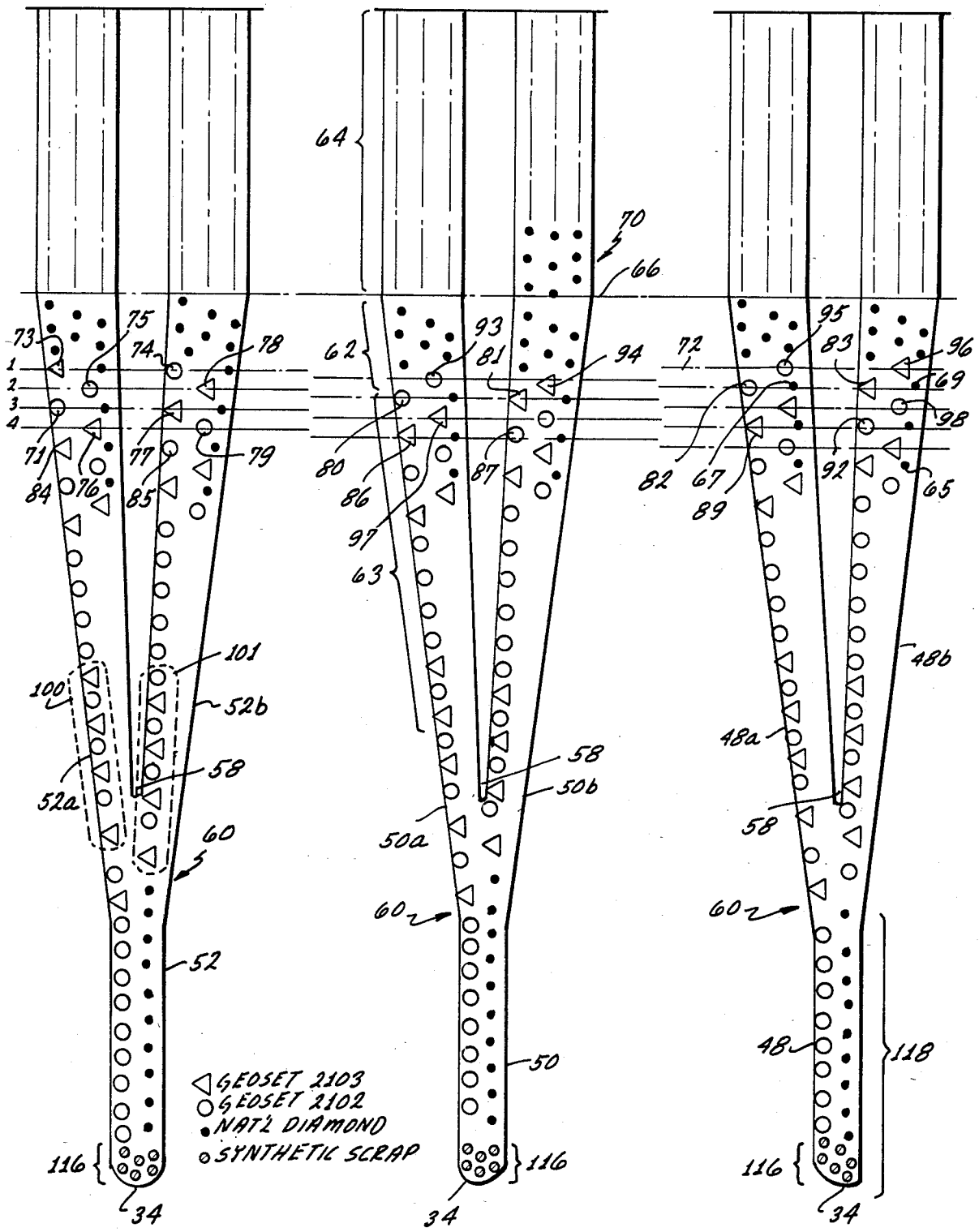
FIG. 5*a* is a diagrammatic plot detail diagram showing the placement of diamond cutting elements of the primary pads from the apex through the shoulder to the gage of the bit of FIG. 4.

Consider now the diagrammatic plot detail illustrated in FIG. 5*a* which shows the three pads generally denoted by reference numerals 48, 50 and 52. There are three primary pads 48–52 on the bit face as shown in the plan view of the bit face in FIG. 4. In other words, the series of pads 48, 50, and 52 or truncated versions appear in sequence five times around bit 32 of FIG. 4. Each of the pads 48–52 are laid out flatly in FIG. 5*a*, although in fact the cross section of bit 32 is actually shown from the centerline 54 to the outer diameter 56 of the bore as illustrated in profile in FIG. 6*a*. Pads 48–52 thus lie on the surface of bit 32 in the cross sectional curve illustrated in FIG. 6*a* and in the plan view as illustrated in FIG. 4. FIG. 5*a*, then, is a diagrammatic view of each of the pads of the repetitive sequence showing the placement of the diamond cutting elements, again diagrammatically shown and previously described in connection with the FIGS. 1–3.

Consider, for example, pad 52 in FIG. 5*a*. Pad 52 begins at center 34 of bit 32 and extends as a single pad from center 34 to approximately point 58 which is located at or near nose 60 of bit 32 where pad 52 broadens and divides into two separate pads generally denoted by reference characters 52*a* and 52*b*. Pads 52*a* and 52*b* are separated by a collector 42 best shown in FIG. 4. Pads 52*a* and 52*b* continue along flank 63 and shoulder 62 of bit 32 to gage 64 and thereafter continue upwardly along gage 64.

Figure 6B:
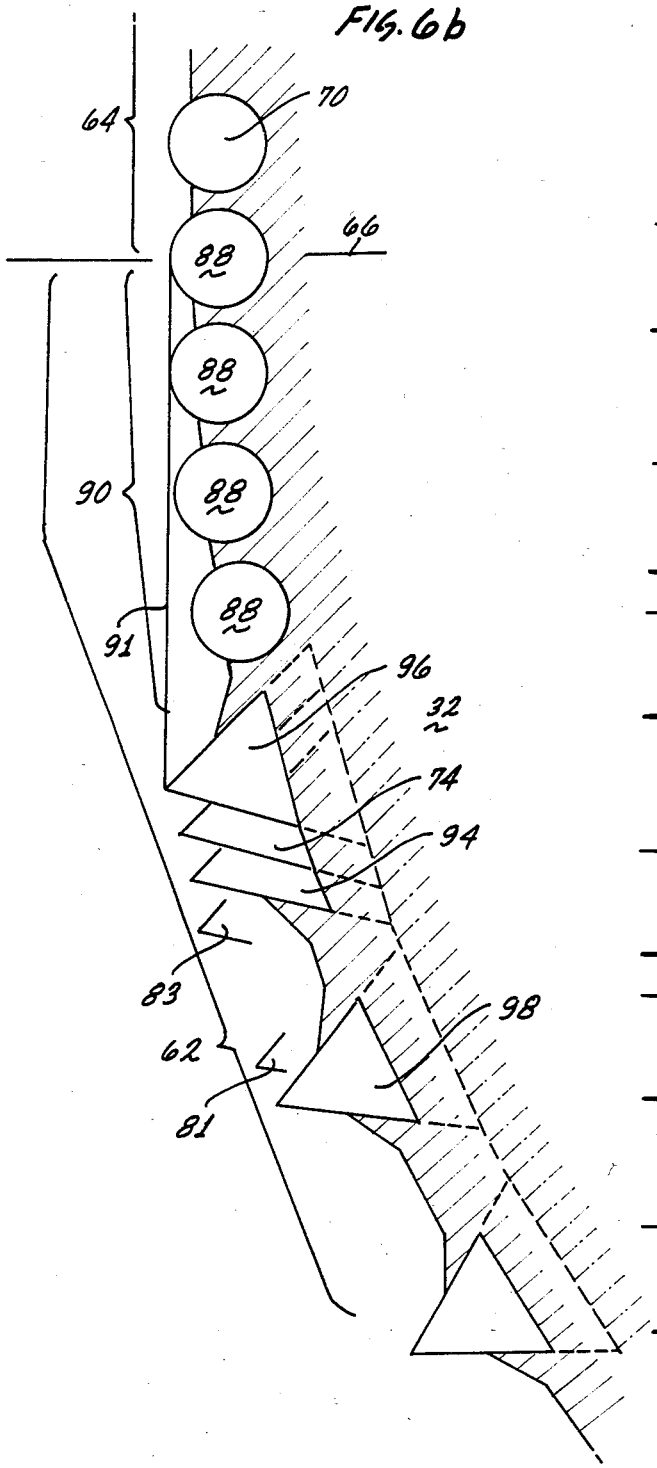
FIG. 6*b* is an enlarged view of a portion of FIG. 6*a* included within circle 6*b*.
Figure 6A:
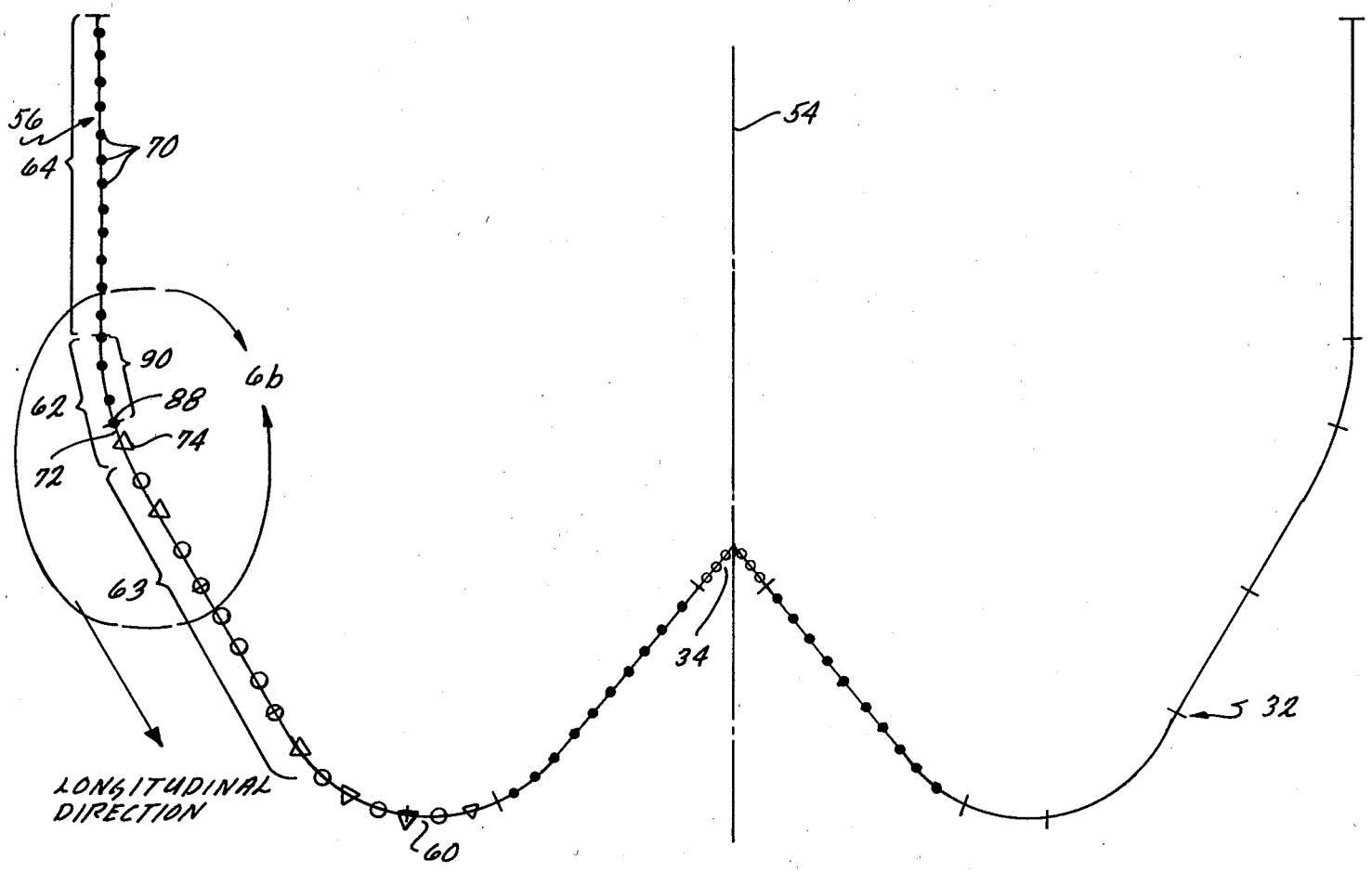
FIG. 6*a* is a diagrammatic profile in longitudinal cross section of the rotary bit shown in plan view in FIG. 4.

Referring now, for the moment, to FIG. 6*a*, the maximum linear velocity of bit 32, when rotated, occurs at point 66 just at the beginning of gage 64. Diamond cutting elements on shoulder 62 placed just below point 66 also encounter linear cutting velocities substantially near the maximum achieved by bit 32. Typically, it is the diamond cutting elements in this area that are subjected to the highest degree of wear and it is these cutting elements that usually fail first and cause bit 32 to "go out of gage". In addition, when tripping the bit in and out of the bore, it is also these cutting elements which are often subjected to the most abuse. Sometimes a bore will swell and must be reamed by these cutters. Further, in an intentional reaming operation these cutters will bear the primary brunt of the wearing action. Reaming is an extremely abusive operation with respect to the cutting elements. Once the gage or diameter of the bore drilled by bit 32 is established, it is highly desirable that the drill bit not further enlarge the bore diameter. Thus, diamond cutting elements placed on gage 64 of bit 32 are designed and intended to keep the bore "in gage" and are not intended to enlarge the diameter of the bore in any manner. Thus, these gage elements do little, if any, bore cutting except where used in reaming an undersized hole. Cutting action of the rotary bit in general, and in particular to establish the diameter of the bore, is accomplished with the cutting elements on the bit face. Once these elements are lost or have their cutting action impaired in any manner, the usable life of the entire rotary bit essentially ends.

Refer again to the cutting elements of the present invention as described in connection with FIGS. 1–3 in the illustrated embodiment and as particularly shown in FIG. 3, the extent of projection of element 14 from bit face 12, namely distance 68, is approximately 2.6 to 2.7 millimeters when polycrystalline synthetic diamonds are used. In the illustrated embodiment, the cutting elements in gage 64 are typically chosen as industrial grade natural diamonds for economic and design reasons of a size of approximately 6–8 per carat. In other embodiments new or used PCD elements, set face or side out, may be used to better advantage.

Turn again to FIG. 5*a*. Without the benefit of the present invention a bit with synthetic diamond elements on the face up to the gage would always be over-gage. When embedded in gage 64 according to conventional principles, the projection of such natural diamonds, generally denoted by reference numeral 70, is typically no more than 0.64 millimeters beyond the bit surface. As best illustrated in the enlargement of FIG. 6*b*, if the synthetic polycrystalline diamond cutting elements on shoulder 62 were extended to point 66 next to gage 64, such a diamond would extend approximately 2.7 millimeters from the bit face and the next adjacent diamond upwardly on gage 64, a natural diamond, would extend only 0.64 millimeters from the bit face. The result would be that the synthetic diamond would be substantially over-gage at point 66 where maximal lineal cutting velocity is incurred. Such a bit cannot be shipped to the field.

Therefore, according to the present invention as shown in FIG. 6*b*, a key level 72 is identified on shoulder 62 above which the synthetic polycrystalline diamond cutting elements are not positioned. Consider the enlargement of FIG. 5*b*, where pad 48*b* includes a polycrystalline diamond bearing tooth 96 positioned on shoulder 62 at key level 72. A pattern of synthetic polycrystalline diamond cutting elements are disposed below key level 72 as best seen in FIG. 5*a* on pads 48–52. Above key level 72 and below gage point 66, shoulder 62 is provided with a patterned array of cutting elements in keyspace 90, generally denoted by reference numeral 88, each cutting element incorporating a natural diamond of a size of approximately 5 per carat.

Figure 5B:
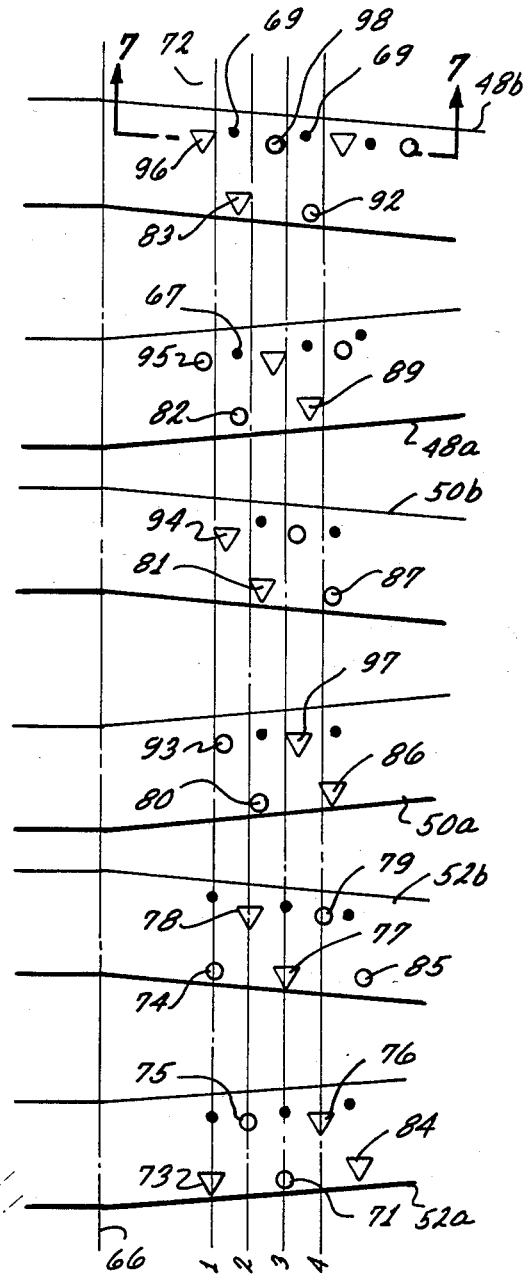
FIG. 5*b* is an enlarged view of a portion of the bifurcated pads of FIG. 5*a* shown in diagrammatic form.

Turning again to FIG. 6*b*, wherein the projection of the cutting elements from the bit face are shown in exaggerated profile, tooth 96 is shown at key level 72 and extends perpendicularly from the bit face of shoulder 62 by the designed amount of approximately 6.7 millimeters. 5 per carat natural diamonds 88 are then positioned in a transition region or keyspace 90 on shoulder 62 to gage point 66. According to the curvature of the illustrated embodiment, key level 72 is chosen so that uppermost polycrystalline synthetic diamond tooth 96 extends radially from center line 54 by an amount substantially equal to the extent of gage teeth 70 from center line 54 of bit 32 as indicated by line 91 in FIG. 6*b*. Thus, tooth 96 is "in gage" and no other principal cutting tooth is positioned on the bit face of bit 32 beyond the designed gage diameter. Transition diamonds 88 thus provide a gage-type keyspace 90 transitioning into smaller 6 to 8 per carat gage diamonds 70 on gage 64. Both GEOSETS 2102 and 2103 are shown in FIG. 6*b* with the larger 2103 GEOSET shown in dotted outline and the smaller 2102 GEOSETS shown in solid outline. FIGS. 5*a* and 5*b* show the GEOSETS symbolically as open triangles and circles, with the solid circles being natural diamond. FIG. 6*b*, however, shows the diamond cutting elements in their ideal geometric shape where round natural diamonds are depicted for the sake of clarity as spherical. Clearly, other shaped diamonds could be substituted for the rounded natural diamonds.

Turning now to FIG. 5*a*, consider again the disposition of diamonds illustrated on pad 48. A periodic pattern of diamond types is shown below key level 72 on pads 48*a* and 48*b*. Circular elements representing teeth 82 and 95 indicate a first polycrystalline synthetic diamond type, such as the triangular prismatic diamond GEOSET 2102, having equilateral triangular faces of approximately 4.0 millimeters and a thickness of 2.6 millimeters. Teeth 95 and 82 thus include a GEOSET 2102 diamond while teeth 83 and 96 include a similarly shaped triangular prismatic synthetic polycrystalline diamond GEOSET 2103, having an equilateral triangular face of approximately 6.0 millimeters and a thickness of 3.7 millimeters. Teeth 82 and 83 are in line with radially adjacent teeth 67 and 69 which include a 5 per carat natural diamond. Thus, the pattern of teeth 96, 83, 69, 98, 92 and 65 form a pattern which is again repeated at least partially on pads 48*a* and 48*b*. Thereafter, polycrystalline synthetic diamond bearing teeth are placed on a single row on or near the leading edge of pads 48*a* and 48*b* down to the point where each of these pads merge to form single land 48. Single pad 48 then continues with a double row of teeth on portion 118, one row being of polycrystalline synthetic material and the other row including 5 per carat natural diamond material. The very tip portion 116 is then heavily provided with scrap portions of polycrystalline synthetic material which are recycled from previosly worn bits or set with various types of natural diamonds. Pads 50 and 52 are provided with similar patterns.

Referring now to FIG. 4 it can be seen that pads 48–52 are repeated about a bit face in a repetitious pattern with only three pads reproduced in full length as shown in FIG. 5*a*. Most of the pads are truncated or shortened to provide room for main waterways 36 of bit 32. Bit face designs other than that shown in FIG. 4 could have been used with the tooth placement of FIGS. 5*a–b* and 6*a–b*. For example, in other designs, pads 48–52 as shown in FIG. 5*a* or portions thereof may be repeated only three or four times about the bit face rather than the five times illustrated in the design of FIG. 4.

Refer now to FIGS. 5*a*, 5*b* and 6*b* wherein the relationship between the spacing of teeth on adjacent pads is described. Consider again FIG. 5*b* and bifurcated pads 52*a*, 52*b* of pad 52 shown in its entirety in FIG. 5*a* and in fragmentary view in FIG. 5*b*. In FIG. 5*b*, tooth 73 on pad 52*a* and tooth 74 on pad 52*b* are in line with each other and can be considered as the starting point or initial reference location for all other teeth on the bit as will be described in the following. The distance between two adjacent teeth in the same row on the same pad is defined as a unit of spacing and is uniform throughout the tooth configuration on the bit face. For example, the distance between tooth 71 and 73 is a unit space, as is the distance between tooth 75 and 76 in the second row of pad 52*a*. Similarly, the distance between tooth 74 and 77 is a unit space, as is the distance between teeth 78 and 79 in the second row on pad 52*b*. The unit space is thus defined as that distance between two longitudinally adjacent teeth in a given row on a pad.

Consider now bifurcated pads 50*a* and 50*b* of pad 50 shown in its entirety in FIG. 5*a* and in fragmentary view in FIG. 5*b*. Turning to FIG. 5*b*, tooth 80 on pad 50*a* and tooth 81 on pad 50*b* are in line with each other and are offset away from line 1 by two-thirds of a unit space from the corresponding azimuthal level of teeth 73 and 74 on pads 52*a* and 52*b*, respectively. Each of the azimuthal lines vertically drawn in FIG. 5*b* are one sixth of the unit space apart. Similarly, tooth 82 on pad 48*a* and tooth 83 on pad 48*b* are in line with each other and are offset away from line 1 by one-third of a unit space from the azimuthal level of teeth 73 and 74 on pads 52*a* and 52*b*, respectively. This pattern is repeated every three pads circumferentially around the bit.

For example, tooth 71 on pad 52*a* and tooth 77 on pad 52*b* are in line with each other and offset from teeth 73 and 74 by one unit spacing longitudinally along the face of the bit. Tooth 86 on pad 50*a* and tooth 87 on pad 50*b* are similarly longitudinally offset from tooth 80 on pad 50*a* and tooth 81 on pad 50*b* respectively by a unit spacing, and are longitudinally offset from teeth 71 and 77 by two-thirds of a unit space. Tooth 89 on pad 48*a* and tooth 92 on pad 48*b* are also in line with each other and are longitudinally offset from teeth 82 and 83 respectively by one unit spacing, and are longitudinally offset from teeth 71 and 77 by one-third of a unit space. Again, this pattern is repeated circumferentially around the bit for each unit of longitudinal spacing on the bit face.

As illustrated in the FIGS., and in particular in FIG. 5*b*, a second row of teeth is provided on each bifurcated pad which second row is disposed behind and offset behind its adjacent front row of teeth just described above by one-half of a unit space. For example, tooth 97 on pad 50*a* is set halfway between and behind teeth 80 and 86 on pad 50*a*. The teeth in the second row are set in a pattern similar to the pattern just described. The teeth within the second row on each of the pads are related to the second row teeth on adjacent pads by offset longitudinal spacing of multiples of one-third of the unit space in the same manner as the teeth of the first row.

Teeth are disposed on the bit face according to the described pattern up to the region of bit shoulder 62, shown in FIG. 6*b*, until key point 72 is reached. However no tooth is disposed on the bit face above key level 72 or between key level 72 and gage 66 in keyspace 90. Referring again to FIG. 5*b*, it can readily be seen that teeth 74 and 73 are the highest teeth on pads 52*a* and 52*b*, that is nearest gage point 66. Teeth 74 and 73 are one-sixth of a unit space below key level 72. Teeth 93 and 94 on pads 50*a* and 50*b* respectively are set one-third of a unit space below key level 72. Only teeth 95 and 96 on pads 48*a* and 48*b* respectively are set exactly at key level 72. Therefore, teeth 95 and 96 at key level 72 occur only at the end of the cutting pattern. Therefore, beginning at key level 72, a tooth and an aligned backup tooth is presented at every one-sixth interval of a unit space from key level 72 toward center 34 of the bit. As would be seen in an azimuthal swath cut by the bit as it rotates, the tooth density is increased twofold from six per unit space for the first rows on the three bifurcated pads to twelve per unit space over the same three bifurcated pads by the addition of the offset second row of teeth on each pad. Each repetition of the pattern thus provides redundancy of the 12 per unit space coverage of teeth. Tooth density is thus increased greatly over the density achieved by the placement of teeth in a single row on a single pad. As a result, the cutting action is smoother, more efficient, and the life of the bit is substantially increased.

The unit space between teeth as described in the above pattern was divided in thirds. Such a pattern has been described here only for the purposes of illustration and it must be understood that other multiples of division could have been chosen as well without departing from the scope of the invention.

Referring now to FIG. 5*a*, the teeth set on pads 48–52 are further distinguished from each other by including different types of diamond material within the tooth. Therefore, there is a distribution of diamond-type material which is included and superimposed upon the geometric pattern of teeth described above. Consider again tooth 73 on pad 52*a* in FIG. 5*a*. Tooth 73 is illustrated in FIG. 5*a* and 5*b* by a triangle to indicate that tooth 73 includes a one carat GEOSET 2103. Tooth 74 which is aligned behind tooth 73 and included within the first row in pad 52*b* includes a one-third carat GEOSET 2102. This same alternation of diamond type material included within the teeth repeats on pads 50*a* and 50*b* with tooth 80 including a GEOSET 2102 and azimuthally aligned tooth 81, including a GEOSET 2103. Similarly, pads 48*a* and 48*b* include tooth 82, which includes a 2102 GEOSET and tooth 83 which includes GEOSET 2103. Beginning with tooth 84 on the first row on pad 52*a*, the pattern is reversed. In other words, tooth 84 is set with a GEOSET 2103 while tooth 85 in the first row on pad 52*b* is set with a GEOSET 2102. This pattern is again repeated on pads 50*a* and 50*b* wherein tooth 86 includes a GEOSET 2103 and aligned tooth 87 a GEOSET 2102; and on pads 48*a* and 48*b* wherein tooth 89 includes a GEOSET 2103 and tooth 92 a GEOSET 2102.

The alternation of diamond-type material included within the teeth continues across bit shoulder 62 to one unit space past the bottom of junk slot 44, not illustrated in FIG. 5*a*, but which is shown in plan view in FIG. 4.

Two features should be noted with respect to the diamond placement pattern as shown in land 52 on FIG. 5*a*. Firstly, pads 52*a* and 52*b* include two portions 100 and 101 wherein the teeth alternately include polycrystalline diamond elements of differing sizes, namely, a GEOSET 2102 diamond alternated with a GEOSET 2103 diamond. Since in each case, regardless of diamond size, the extent of the tooth projection from the bit face is identical for each tooth in portions 100 and 101, the different sized diamond elements included within the teeth result in alternating extents of disposition within the matrix material of the bit face, namely, the larger 2103 diamond is embedded more deeply than the smaller 2102 diamond. This is shown in FIG. 7 in diagrammatic sectional view along line 7—7 in FIG. 5*b* of pad 48*b*. Thus, a higher density of deeply embedded, large diamond cutting elements can be achieved than would otherwise be possible. In addition, the larger diamonds tend to be more impact resistant and their fixation to the bit is more erosion resistant. Therefore, a mixed series of larger and smaller diamonds provides better performance than a similar series of only smaller diamonds, and is more economical to manufacture than a similar series of only larger diamonds.

Figure 8:
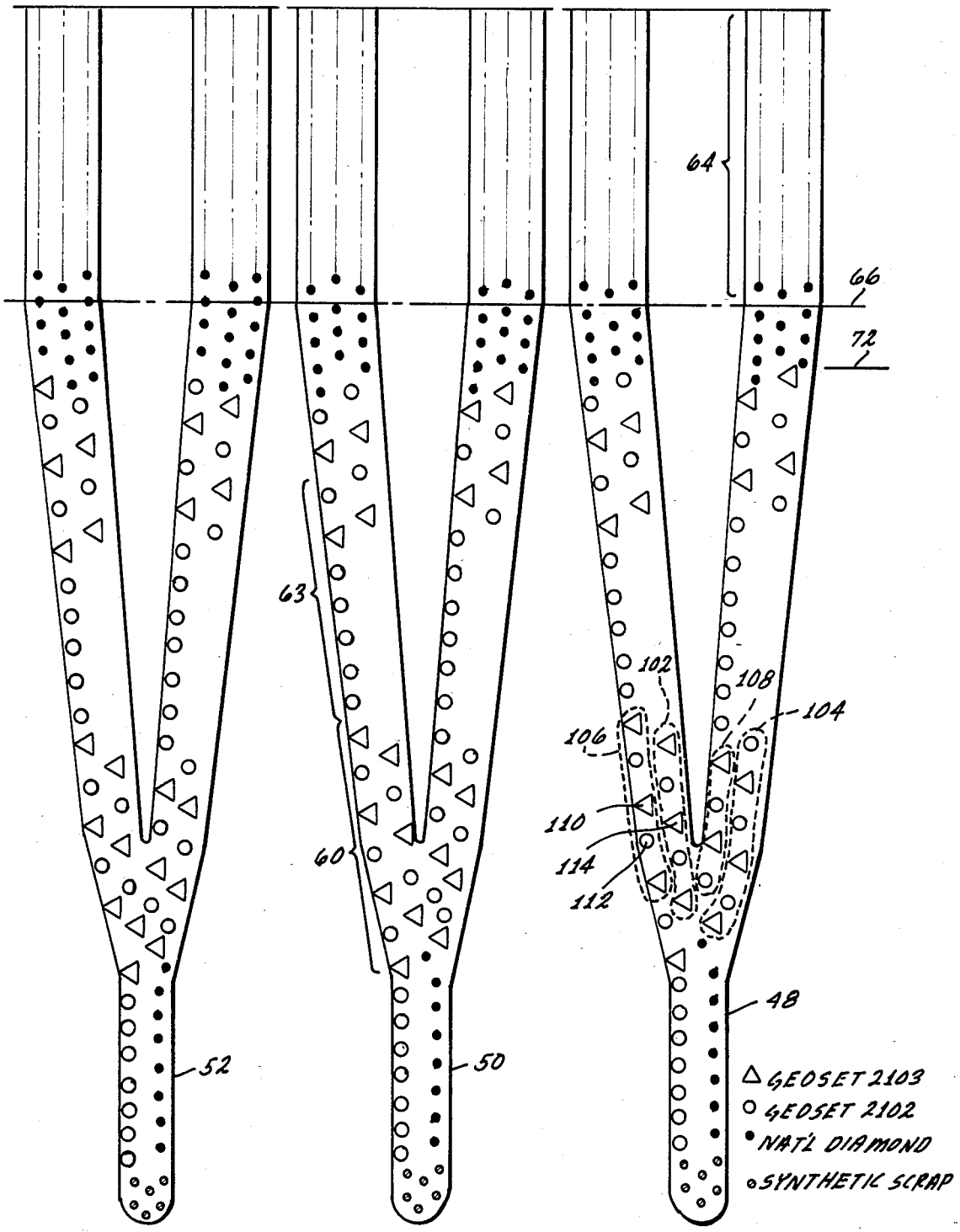
FIG. 8 is a partial diagrammatic plan view of another embodiment of the tooth plot similar to that shown in FIG. 5*a* wherein an alternative plot is provided on the lands.

Turning now to FIG. 8, a second embodiment of a tooth or diamond plot in addition to that shown in FIG. 5*a* is diagrammatically illustrated in symbolic plan view. The plot of FIG. 8 differs primarily from that of FIG. 5*a* in that the total number of alternating larger GEOSET 2103 diamonds and smaller GEOSET 2102 diamonds set as described above in connection with FIG. 7 has been increased and second rows 102 and 104 of such alternating diamond-bearing teeth have been disposed on each pad behind its corresponding leading rows 106 and 108, respectively, which leading rows are also shown on the pads of the plot diagram of FIG. 5*a* as portions 100 and 101. Rows 102 and 104 have been shown collectively in the case of pad 48 as encircled in dotted outline for the purposes of clarity of description. The number of larger GEOSETS 2103 in row 106, for example, are in the embodiment of FIG. 8 reduced to three in number, whereas in the corresponding row in the embodiment of FIG. 5*a*, four such GEOSETS 2103 are used at the similar portion 100 of pad 52. The second row, row 102, corresponding to row 106 and row 104 corresponding to row 108 of diamond elements on pad 52, are positioned on the pad to lie behind and in the half spaces between the diamond elements in the preceeding row. Namely, diamond element 114 is placed behind and halfway between leading diamond elements 110 and 112. Otherwise, placement of diamonds on the pads as illustrated in the plot diagram of FIG. 8 is substantially identical to that described in connection with the embodiment of FIG. 5*a*.

It has been found that a plot setting as shown in FIG. 8 provides additional cutting capacity and bit life, particularly near nose 60 of the bit. By using the smaller GEOSET 2102 diamond elements along flank 63 of the bit and doubling up the tooth rows to increase diamond density in the region of nose 60, both improved performance and bit life can be achieved without both improved performance and bit life can be achieved without substantially increasing the number of diamond elements used in the bit and thus increasing its cost. It is believed that nose 60 may be subject to greater abuse than flank 63 because of the vertical weight of the drill string is supported in large part directly by nose 60. Similarly, a double row of teeth including a high proportion of larger 2103 GEOSETS is provided on the shoulder up to key level 72 to accommodate the greater wear and abuse to which such peripherally located teeth are subjected. The remaining portions of the bit are then provided with smaller diamond elements and a lower tooth density suitable to those more lightly worn or abused portions of the bit.

Many alterations and modifications may be made by those having ordinary skill in the art without departing from the spirit and scope of the present invention. For example, although the illustrated embodiment has assumed a certain bit face style distinguished by a specified configuration of nozzles, pads, waterways, and collectors as shown in more detail in FIGS. 4–6, any other bit face employing the principles of the present invention could also be equally employed. Thus, the illustrated embodiment has been described only for the purposes of clarification and example and should not be taken as limiting the scope of the following claims.

I claim:

1. In a rotating bit with a gage defining a bore diameter including, a center and shoulder transitioning between said center and gage, an improvement comprising:

a plurality of polycrystalline diamond (PCD) cutting elements disposed on said shoulder, said elements disposed on said shoulder perpendicularly extending therefrom by a first predetermined distance; and a plurality of diamond elements disposed on said gage and perpendicularly extending from said gage of said rotary bit by a second predetermined distance, the diameter of a hole bored by said rotary bit being defined by said diamond elements disposed in said gage, said polycrystalline diamond cutting (PCD) elements being disposed on said shoulder only up to a key level definded with respect to said gage, said polycrystalline diamond (PCD) element cutting at said key level defining a drilled bore substantially equal in diameter to said diameter defined by said diamond elements disposed in said gage.

2. The improvement of claim 1 wherein that portion of said shoulder extending between said key level of said shoulder and said gage has disposed therein a plurality of diamond cutting elements perpendicularly extending from said bit face by a third predetermined distance.

3. The improvement of claim 1 wherein the plurality of PCD cutting elements disposed on said nose and shoulder are disposed thereon in a pattern, said pattern being azimuthally replicated a plurality of times about said bit, the beginning of each replication of said pattern beginning at a level on said shoulder of said rotary bit at a distance displaced from said key level by a predetermined amount.

4. The improvement of claim 3 wherein each replication of said pattern of PCD cutting elements on said shoulder of said bit also includes a unit pattern of said PCD elements within each said replication, said unit pattern within each said replication being internally periodic, and wherein said predetermined amount of displacement of each replication from said key level as compared to a preceeding one of said replication of patterns of PCD elements is a submultiple distance of the periodic unit pattern included within each replication.

5. The improvement of claim 1 wherein said plurality of PCD cutting elements are disposed on said shoulder of said bit face in a pattern including replications of a group of three pads, each pad having a periodic pattern of said PCD cutting elements disposed on that portion of said pad extending across said shoulder of said bit, said key level being defined by a first one of said three pads, the beginning of said periodic pattern on said first pad being offset one-sixth the distance of spacing between adjacent PCD cutting elements on said pad from said key level, and said periodic pattern on a second one of said three pads being displaced longitudinally toward said center of said bit from said key level by five-sixths the distance of spacing between said PCD cutting element on said pad, said periodic pattern on a third one of said three pads being offset toward said center of said bit by one half the distance of said spacing between said PCD cutting elements from said key level.

6. In a rotating bit with a gage defining a circumferential perimeter, a center and a flank and shoulder transitioning between siad center and gage, an improvement comprising:

a plurality of PCD elements disposed on said bit, said elements perpendicularly extending from said center and flank and shoulder by a first predetermined distance, said plurality of PCD elements being longitudinally disposed on said flank and shoulder up to a key level beneath said gage, said key level being defined as that longitudinal level on said bit where the radially outermost perpendicularly extending portion of said PCD elements as measured from the longitudinal axis of said bit is substantially identical to the diameter of said gage of said bit, whereby the azimuthal sweep of said PCD elements near said key level is substantially equal to the azimuthal sweep of said gage.

7. The improvement of claim 6 wherein said plurality of PCD elements are arranged and configured on said bit on a plurality of pads, said PCD elements on each pad being disposed on said corresponding pad in a periodic unit pattern, said plurality of pads being related among each other in a patterned relationship so that said PCD elements disposed on said related pads azimuthally trace a predetermined sweep as said bit rotates.

8. The improvement of claim 7 wherein said plurality of related pads are related by relative longitudinal displacement of said periodic unit pattern of PCD elements on each corresponding pad, a unit pattern on one pad being longitudinally displaced relative to the unit pattern on an adjacent pad by a predetermined distance.

9. The improvement of claim 8 wherein said predetermined amount of distance characterizing the relative displacement between the unit pattern on one pad as compared to the unit pattern on an adjacent pad is defined as a submultiple of the longitudinal distance between adjacent PCD elements on a pad, said longitudinal distance of relative displacement between unit patterns on each corresponding pad being displaced in a longitudinal direction away from said key level whereby all PCD elements are disposed on said bit below said key level and away from said gage, and whereby effective density of said PCD elements as seen on the azimuthal surface of said bore is substantially increased over that achieved by said periodic unit pattern of PCD elements on each pad singly.

10. In a rotating bit with a gage defining a circumferential perimeter characterized by a gage diameter, and including a center and a face transitioning between said center and gage, an improvement comprising:

a plurality of diamond cutting elements disposed on said bit, said diamond cutting elements disposed on said gage extending from the surface of said bit by a first predetermined distance, thereby defining said gage diameter, said diamond cutting elements disposed on said face extending above the surface of said bit by a second predeteremined distance, greater than said first predetermined distance, said diamond cutting elements being disposed on said face up to a key level, said key level spaced from said gage and being defined as that longitudinal level on said rotating bit where the outermost extending portion of said diamond cutting elements disposed on said shoulder, as measured from the longitudinal axis of said bit, is substantially equal to said gage diameter, wherein said plurality of diamond cutting elements are disposed on said shoulder in a plurality of rows, each row being characterised by a uniform spacing between adjacent diamond cutting elements within each said row, each row extending longitudinally across the surface of said bit generally in a direction on said bit from said gage toward said center, the location on said bit of said diamond cutting elements in each row being related to the location of said diamond cutting elements on said bit in adjacent rows to form a subplurality of related rows, said diamond cutting elements in adjacent rows being displaced from said key level by a submultiple of the distance between adjacent diamond cutting elements within a row so that said diamond cutting elements are at or below said key level and so that said subplurality of related rows provide in aggregate an effective increased density of diamond cutting elements as seen in an azimuthal swath cut by said bit as said bit rotates.

11. In a rotating bit including a center, gage and face, said face providing a transition between said center and gage and including a nose generally forming a lower horizontal portion of said bit during normal drilling operations, an improvement comprising:

a plurality of diamond cutting elements disposed on said bit, said plurality of diamond cutting elements formed in at least two paired rows on said nose of said bit, said rows generally extending in a direction from said gage to said center across said nose, said paired rows including diamond cutting elements staggered relative to each other wherein a diamond cutting element in one row is spaced behind and between diamond cutting elements in the adjacent one of said pair of rows, and wherein said face of said bit is provided with a single row of said diamond cutting elements along said flank of said bit corresponding to one row of said paired rows of diamond cutting elements on said nose of said bit.

12. The improvement of claim 11 wherein said gage of said bit also includes paired rows of said plurality of diamond cutting elements, diamond cutting elements of one row on said gage being disposed behind and between diamond cutting elements in the adjacent one of said paired rows, whereby said gage and nose which are exposed to greater wear and abuse, are provided with a higher density of cutting elements, and whereby density of cutting elements elsewhere on said bit may be reduced thereby minimizing cost and manufacture of said bit and extending bit lifetime and improving cutting performance.

13. The improvement of claim 12 wherein said plurality of diamond cutting elements are disposed in a plurality of areas of the surface of said bit, a plurality of sizes of PCD cutting elements being disposed in said bit and extending above said surface of said bit, at least two of said plurality of sizes of PCD elements having a substantially different size, said plurality of elements being disposed on said surface of said bit in a predetermined fixed pattern, at least two sizes of said plurality of sizes of PCD elements being disposed in said predetermined pattern in the same area of said surface of said bit, cutter density of said bit being variable within said predetermined pattern by selection of said at least two sizes of PCD elements in said area from said plurality of sizes of said cutting elements, whereby cutter density on said bit may be selectively and substantially varied without alteration of position of said cutting elements on said bit.

14. In a rotating matrix infiltration bit having a plurality of PCD cutting elements disposed in a plurality of areas of the surface of said bit, an improvement comprising a plurality of sizes of PCD cutting elements disposed in said bit and extending above said surface of said bit, at least two of said plurality of sizes of PCD elements having a substantially different size, said plurality of elements being disposed on said surface of said bit in a predetermined fixed pattern, at least two sizes of said plurality of sizes of PCD elements being disposed in said predetermined pattern in the same area of said surface of said bit, cutter density of said bit being variable within said predetermined pattern by selection of said at least two sizes of PCD elements in said area from said plurality of sizes of said cutting elements, whereby cutter density on said bit may be selectively and substantially varied without alteration of position of said cutting elements on said bit.

15. An improvement in a rotating bit including a center, gage and face, said face providing the transition between said center and gage and including a nose generally forming a lower horizontal portion of said bit during normal drilling operations, said improvement comprising:

a plurality of diamond cutting elements disposed on said bit, said plurality of diamond cutting elements formed in a group of rows including a first predetermined number of rows, said group of rows being replicated about said face of said bit, said rows of diamond cutting elements within said group of rows azimuthally spaced one from the other and longitudinally offset from one another from said gage of said bit toward said center of said bit, each said row of said group being longitudinally offset from adjacent rows of said bit by a submultiple of a unit spacing according to said first predetermined number of said rows within said group, said unit spacing being defined as the distance between longitudinally adjacent cutting elements within a single row, whereby said first predetermined number of rows included in said group of rows provide an azimuthal swath of cutting elements as said bit rotates wherein a cutting element is positioned in said azimutal swath at each submultiple spacing within each longitudinal distance of unit spacing.

16. The improvement of claim 15 wherein said predetermined number of rows within said group of rows are doubled, at least in part, by a second row of cutting elements behind and aligned with each one of said first predetermined number of rows, whereby bifurcated groups of rows are formed.

17. The improvement of claim 16 further comprising a plurality of a second predetermined number of rows of cutting elements within each said group, said plurality of rows of cutting elements of said second predetermined number being longitudinally offset by half a unit space from said plurality of first predetermined number of rows of cutting elements, whereby density of cutting elements is doubled within said azimuthal swath cut by said bit as said bit rotates, a cutting element being presented at each submultiple spacing within said longitudinal distance of unit space and at each point halfway between adjacent submultiple spacings.

18. The improvement of claim 17 wherein said plurality of cutting elements includes a plurality of diamonds of a multiplicity of types of diamond material, said multiplicity of types of diamond material being selectively disposed in each of said cutting elements to form a patterned periodicity of types of diamond material, as well as cutting element placement on said bit.

19. The improvement of claim 15 further comprising a plurality of a second predetermined number of rows of cutting elements within each said group, said plurality of rows of cutting elements of said second predetermined number being longitudinally offset by half a unit space from said plurality of first predetermined number of rows of cutting elements, whereby density of cutting elements is doubled within said azimuthal swath cut by said bit as said bit rotates, a cutting element being presented at each submultiple spacing within said longitudinal distance of unit space and at each point halfway between adjacent submultiple spacings.

20. The improvement of claim 15 wherein said plurality of cutting elements includes a plurality of diamonds of a multiplicity of types of diamond material, said multiplicity of types of diamond material being selectively disposed in each of said cutting elements to form a patterned periodicity of types of diamond material as well as cutting element placement on said bit.

21. A method for altering density of cutter elements of a rotating matrix infiltration bit, said elements being disposed on said bit in a predetermined pattern, said method comprising the step of selectively disposing selected sizes of cutting elements on said bit in said predetermined pattern without alteration of position of each cutting element on said bit regardless of said selected size.

22. A method for altering density of cutter elements of a rotating bit, said elements being disposed on said bit in a predetermined fixed pattern, said method comprising the step of selectively disposing selected types of cutting elements on said bit in said predetermined pattern without alteration of position of each cutting element on said bit regardless of said selected type.

* * * * *